United States Patent [19]

Pietsch et al.

[11] Patent Number: 4,922,870

[45] Date of Patent: May 8, 1990

[54] ARRANGEMENT FOR SUPPORTING A CRANKSHAFT

[75] Inventors: Albert Pietsch, Illingen; Wolf Boll, Weinstadt, both of Fed. Rep. of Germany

[73] Assignee: Daimler-Benz AG, Stuttgart, Fed. Rep. of Germany

[21] Appl. No.: 349,425

[22] Filed: May 8, 1989

[30] Foreign Application Priority Data

May 6, 1988 [DE] Fed. Rep. of Germany ..... 3815508

[51] Int. Cl.[5] ..... F02F 7/00

[52] U.S. Cl. ..... 123/195 R; 123/195 H; 384/429; 384/432

[58] Field of Search ..... 123/195 R, 195 H; 384/429, 432, 433

[56] References Cited

U.S. PATENT DOCUMENTS

| | | | |
|---|---|---|---|
| 3,464,398 | 9/1969 | Scheiterlein et al. | 123/195 R |
| 3,540,425 | 11/1970 | Scheiterlein et al. | 123/195 R |
| 3,895,868 | 7/1975 | Castarede | 123/195 R |
| 3,991,735 | 11/1976 | Horstmann | 123/195 R |
| 4,059,085 | 11/1977 | Mansfield et al. | 123/195 R |
| 4,466,401 | 8/1984 | Ogawa et al. | 123/195 R |
| 4,520,770 | 6/1985 | Ogawa | 123/195 H |

FOREIGN PATENT DOCUMENTS

| | | | |
|---|---|---|---|
| 2215990 | 1/1973 | Fed. Rep. of Germany | 384/432 |
| 0653420 | 4/1928 | France | 123/195 H |
| 0664074 | 8/1929 | France | 123/195 R |

*Primary Examiner*—Charles J. Myhre
*Assistant Examiner*—Weilun Lo
*Attorney, Agent, or Firm*—Barnes & Thornburg

[57] ABSTRACT

In a multi-cylinder internal-combustion engine, bearing shell and bearing cap of the bearings for the crankshaft are decoupled from the side walls of the cylinder block which form the crankcase. The bearing shells communicate with the cylinder block directly through column elements. The resilience of the column elements relieves the cylinder block of any transverse flexure by crankshaft forces and reduces the generation of noise.

3 Claims, 1 Drawing Sheet

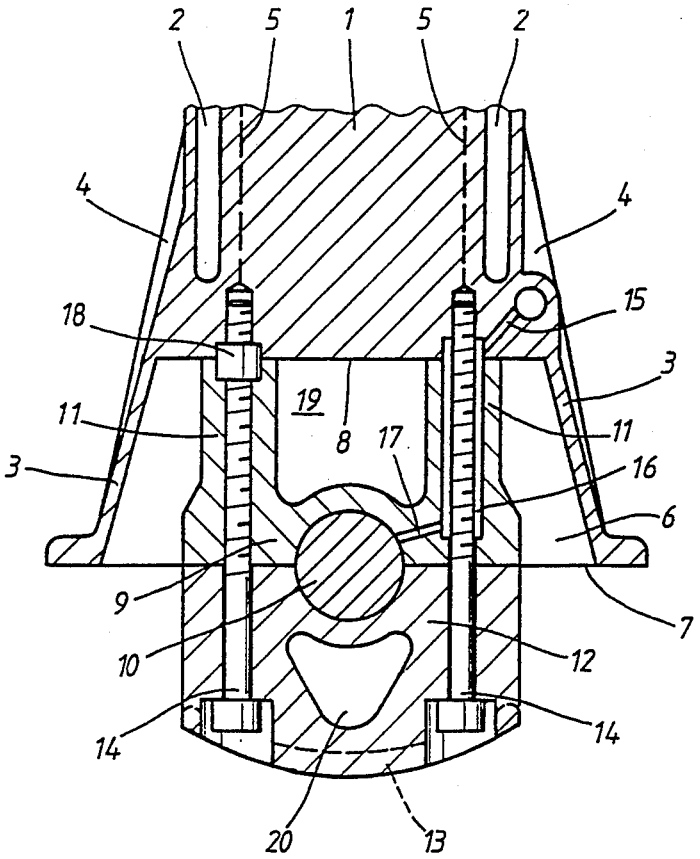
2
5
1
5
2
4
4
18
15
3
19
11
8
17
11
3
16
6
9
7
10
12
14
14
20
13

ARRANGEMENT FOR SUPPORTING A CRANKSHAFT

BACKGROUND AND SUMMARY OF THE INVENTION

The invention relates to an arrangement for supporting a crankshaft of a multicylinder internal-combustion engine having side walls forming a crankcase and connected firmly to a cylinder block and having bearing shells which are connected to said cylinder block and provided with fitted bearing caps to receive the crankshaft.

A multi-cylinder internal-combustion engine is described in German Published Unexamined Pat. App. (DE-OS) No. 3,544,215. The cylinder block of this engine comprises a section which defines the cylinder and a section connected firmly to the latter, or produced integrally with it, which forms the side walls of a crankcase. Bearing walls are fitted between the individual cylinders, connected to the cylinder block and extend from one of the side walls to the other side wall, the bearing walls being provided at their lower surface with semicircular recesses which serve as bearing blocks for a crankshaft.

It is a disadvantage of such an arrangement that the transverse vibrations of the crank transmission, which cause noise, are transmitted through the bearings and the bearing walls to the flexurally soft side walls of the cylinder block and intensive noise emission therefore originates from the side walls of the cylinder block.

An object of the invention is to develop an arrangement of the above-noted type for supporting a crankshaft so that the transverse vibrations of the crank transmission are kept away from the cylinder block and its side walls and no noise is transmitted to said side walls.

This object is achieved according to the invention by providing an arrangement wherein the support elements connected to the cylinder block are formed geometrically as columnar support elements which support the bearing shell at their lower end and exhibit no direct connection to the side walls of the crankcase, and wherein the fitted bearing caps are mutually connected through a continuous bearing bridge which extends in the longitudinal direction of the internal-combustion engine. Further developments and advantages of the invention are discussed below.

In especially preferred embodiments, column elements which carry bearing shells at their lower end are attached to a cylinder block of a multicylinder internal-combustion engine. A crankshaft is inserted into said bearing shells and secured by bearing caps which are screwed to the bearing shells. The bearing caps are mutually connected by a continuous bearing bridge which extends in the longitudinal direction of the internal-combustion engine.

Forces introduced from the crankshaft into the bearings are absorbed in the vertical direction through the column elements of the cylinder block.

Transverse forces are divided approximately as to one half, through the column elements to the cylinder block on the one hand, and to the bridge strut of the bearing bridge which connects the bearing caps on the other hand.

In this way the cylinder block is relieved of transverse flexure and the generation of noise is therefore reduced. Because the bearings exhibit no direct connection with the side walls of the crankcase, there is also no direct transmission of noise to these noise-emitting parts. Moreover, the transverse resilience of the column elements causes a further displacement of the transverse forces from the cylinder block to the bridge strut of the bearing bridge.

Other objects, advantages and novel features of the present invention will become apparent from the following detailed description of the invention when considered in conjunction with the accompanying drawings.

BRIEF DESCRIPTION OF THE DRAWING

The single drawing FIGURE is a partial schematic sectional view depicting a planar section transverse to the crankshaft, of an engine constructed in accordance with a preferred embodiment of the present invention.

DETAILED DESCRIPTION OF THE DRAWING

The single figure shows a cylinder block 1 having a cooling water jacket 2 in cross-section through a bearing plane of the crankshaft. The side walls 3 of a crankcase are connected firmly to the cylinder block 1 or—as shown in this example—produced integrally with it. To strengthen the construction of the flexurally soft side walls 3, they are connected to the cylinder block 1 by stiffening ribs 4. The cooling water jacket 2 surrounds cylinder pipes 5 shown by dashed lines towards both side walls 3. The cylinder pipes 5 lead into a crank chamber 6 which is delimited by both side walls 3 as far as a dividing plane 7. The crank chamber 6, which is open downwards, is closed towards the outside by an oil sump, not shown, fastened to the side walls 3 in the region of the dividing plane 7. A closure plane 8, at an interval from which bearing shells 9 are arranged to receive the crankshaft 10, is produced in the transmission region between the cylinder pipes 5 and the crank chamber 6.

The bearing shells 9 are attached to the cylinder block 1 through free-standing column elements 11 which are not connected to the side walls 3. The crankshaft 10 is retained in its bearing shells 9 by bearing caps 12 placed on the latter. The bearing caps 12 are mutually connected in the longitudinal direction of the cylinder block 1 by a continuous bearing bridge 13. Bearing caps 12, bearing shell 9, column element 11 and cylinder block 1 are held and fastened together by means of a screw fitting 14.

Bearing forces from the crankshaft 10 in the vertical direction are introduced into the cylinder block 1 through the column elements 11. Forces in the transverse direction pass as to approximately one half into the cylinder block 1; the other half is absorbed by the bearing bridge 13. This reduces the transverse flexure of the cylinder block 1 and hence also the noise generation. The transverse resilience inherent in the column elements 11 additionally relieves the cylinder block 1 and directs a greater part of the transverse forces into the bearing bridge 13.

Lubricating oil from an oil pipe can pass through the column element 11 to the bearing 9, 12 of the crankshaft 10 via a lubricating oil duct 15, the bore 16 provided for fastening the bearing 9, 12 to the cylinder block 1, and a further lubricating oil duct 17.

Although the column elements 11 are shown in this figure as produced integrally with the bearing shell 9, this does not constitute a limitation of the invention, but it is also contemplated for the column elements 11 to be produced either integrally with the cylinder block 1, or with the cylinder block 1 and the bearing shell 9, or also to be included and fastened as separate elements between the cylinder block 1 and the bearing shell 9.

A fitting hole 18 shown in the exemplary embodiment serves to adapt the position of the individual crankshaft bearings to each other on the one hand, and to transmit the acting transverse forces not only frictionally but also positively on the other hand.

The bearing bridge 13 may be utilized not only to absorb forces, but also as an oil separator plate and oil baffle plate.

The space 19 present between the column elements 11, and any further perforations 20 in the bearing cap 12 contribute to reduce the weight and favor the resilient flexible behavior of the bearings 9, 12. Losses can be reduced, and the efficiency of the internal-combustion engine improved, by the improved gas breathing in the crank chamber caused by the perforations 19, 20.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Arrangement for supporting a crankshaft of a multi-cylinder internal-combustion engine having side walls forming a crankcase and connected firmly to a cylinder block and having bearing shells which are connected to said cylinder block and provided with fitted bearing caps to receive the crankshaft, wherein support elements connected to the cylinder block are formed geometrically as columnar support elements, which support the bearing shell at their lower end and exhibit no connection to the side walls of the crankcase, for relieving the transmission of transverse vibrations of the crankshaft to the cylinder block and the side walls of the crankcase, and wherein the fitted bearing caps are mutually connected through a continuous bearing bridge which extends in a longitudinal direction of the internal-combustion engine.

2. Arrangement according to claim 1, wherein the columnar support elements are produced integrally with the bearing shells.

3. Arrangement according to claim 1, wherein the cylinder block is constructed to also embrace the columnar support elements and the bearing shells.

* * * * *